US012611045B2

(12) United States Patent
Leng

(10) Patent No.: US 12,611,045 B2
(45) Date of Patent: Apr. 28, 2026

(54) SPRING MODULE AND SPRING CUSHION FOR FURNITURE

(71) Applicant: NEW-TEC INTEGRATION (XIAMEN) CO., LTD.), Fujian (CN)

(72) Inventor: Luhao Leng, Xiamen (CN)

( * ) Notice: Subject to any disclaimer, the term of this patent is extended or adjusted under 35 U.S.C. 154(b) by 0 days.

(21) Appl. No.: 18/837,855

(22) PCT Filed: Nov. 21, 2022

(86) PCT No.: PCT/CN2022/133193
§ 371 (c)(1),
(2) Date: Aug. 12, 2024

(87) PCT Pub. No.: WO2023/155519
PCT Pub. Date: Aug. 24, 2023

(65) Prior Publication Data

US 2025/0143478 A1 May 8, 2025

(30) Foreign Application Priority Data

Feb. 15, 2022 (CN) ..... 202210138638.6

(51) Int. Cl.
*A47C 27/05* (2006.01)
*A47C 23/00* (2006.01)
(Continued)

(52) U.S. Cl.
CPC ..... *A47C 23/0438* (2013.01); *A47C 23/002* (2013.01); *A47C 23/005* (2013.01); *A47C 23/05* (2013.01)

(58) Field of Classification Search
CPC ..... A47C 23/05; A47C 23/005; A47C 23/002; A47C 23/0438; A47C 27/056; A47C 27/05
See application file for complete search history.

(56) References Cited

U.S. PATENT DOCUMENTS 42,053 A * 3/1864 Tylee ..... A47C 27/066 5/261
1,944,614 A 1/1934 Salmon
(Continued)

FOREIGN PATENT DOCUMENTS

CN 1882270 A 12/2006
CN 102894722 A 1/2013
(Continued)

OTHER PUBLICATIONS

Notice of Reasons for Rejection in Japanese Application No. 2024-547863; Date of Mailing: Jun. 30, 2025; 3 pages.
(Continued)

*Primary Examiner* — Matthew Troutman
*Assistant Examiner* — Ifeolu A Adeboyejo
(74) *Attorney, Agent, or Firm* — Perkins Coie LLP

(57) ABSTRACT

A spring module for a spring cushion for furniture. includes a base (20), an end cap (30) and a spring (10) arranged between the base and the end cap. The end cap has a flexible connection portion (33) and is configured to be detachably fixed to the base (20). The flexible connection portion (33) is located radially inside the spring (10). The spring module provides improved stability. The spring cushion has a simple structure and is easy to assemble and disassemble. The disassembled spring modules can be compressed or stacked and nested to save storage and transportation space

19 Claims, 22 Drawing Sheets

(51) Int. Cl.
*A47C 23/043* (2006.01)
*A47C 23/05* (2006.01)

(56) References Cited

U.S. PATENT DOCUMENTS

| | | | | |
|---|---|---|---|---|
| 3,623,171 | A * | 11/1971 | Arkin | A47C 27/20 267/143 |
| 4,644,596 | A | 2/1987 | Husler | |
| 6,477,727 | B1 * | 11/2002 | Fromme | A47C 23/002 5/255 |
| 6,704,960 | B1 * | 3/2004 | Lumgair | A47C 23/002 5/719 |
| 10,971,874 | B2 | 4/2021 | Doi et al. | |
| 11,825,954 | B2 | 11/2023 | Kirchhoff | |
| 2002/0100119 | A1 * | 8/2002 | Constantinescu | F16F 1/18 5/255 |
| 2002/0163114 | A1 * | 11/2002 | Lobry | A47C 23/002 267/142 |
| 2004/0025258 | A1 * | 2/2004 | Van Der Wurf | A47C 27/20 5/718 |
| 2009/0014929 | A1 | 1/2009 | Bock et al. | |
| 2012/0200018 | A1 | 8/2012 | Paz et al. | |
| 2014/0115861 | A1 | 5/2014 | Mellis et al. | |
| 2014/0191454 | A1 * | 7/2014 | Roma | F16F 1/128 267/143 |
| 2014/0191545 | A1 | 7/2014 | Satmary | |
| 2016/0316927 | A1 * | 11/2016 | Thomas | A47C 27/20 |
| 2017/0035211 | A1 * | 2/2017 | Alletto, Jr. | A47C 27/064 |
| 2018/0010662 | A1 * | 1/2018 | de Lima Zocca | F16F 1/06 |
| 2018/0199728 | A1 * | 7/2018 | Leng | A47C 7/144 |
| 2019/0216226 | A1 * | 7/2019 | Theosabrata | A47C 27/084 |

FOREIGN PATENT DOCUMENTS

| | | | |
|---|---|---|---|
| CN | 103347418 | A | 10/2013 |
| CN | 204812973 | U | 12/2015 |
| CN | 206102183 | U | 4/2017 |
| CN | 206403517 | U | 8/2017 |
| CN | 111180648 | A | 5/2020 |
| CN | 210493436 | U | 5/2020 |
| CN | 211275173 | U | 8/2020 |
| CN | 112040812 | A | 12/2020 |
| CN | 212036865 | U | 12/2020 |
| CN | 112220278 | A | 1/2021 |
| CN | 112674538 | A | 4/2021 |
| CN | 112674542 | A | 4/2021 |
| CN | 213429311 | U | 6/2021 |
| CN | 213981766 | U | 8/2021 |
| EP | 3087870 | A1 | 11/2016 |
| EP | 3788915 | A1 | 3/2021 |
| JP | H01112746 | U | 7/1989 |
| WO | 2018118037 | A1 | 6/2018 |
| WO | 2021073589 | A1 | 4/2021 |

OTHER PUBLICATIONS

English translation of International Search Report for PCT/CN2022/133193; Date of Mailing: Feb. 15, 2023; 3 pages.

Examination Report No. 2 for Australian Patent Application No. 2022441052; Date of Mailing: Feb. 17, 2026; 3 pages.

Supplemental European Search Report for European Application No. 22926823.0; Date of Mailing: Dec. 15, 2025; 7 pages.

* cited by examiner

SPRING MODULE AND SPRING CUSHION FOR FURNITURE

FIELD

The present disclosure relates to the field of furniture, and particularly to spring modules and spring cushions for furniture.

BACKGROUND

Large furniture, such as beds, generally are not easy to disassemble, or to reassemble after disassembly. As a result, during moves, still useable beds are sometimes discarded.

A bed is usually composed of a bedstead, a spring cushion and an outer cover. Existing spring cushions are usually integrated, non-disassemble cushions formed by springs and a plurality of superimposed layers. The integral cushions are large in size, thus not easy to disassemble and store.

Existing independent bagged spring bed mattresses are designed to avoid mutual interference between two or more people lying in bed at the same time (for example, in the case of relatively large weight difference between individuals, one of them will inevitably affect other ones when turning over or moving). In such type of bed mattress, each spring is individually packaged in a bag or a sleeve made of non-woven fabrics or other materials. The bags are arranged in a pattern, and then an outer side of the arranged bag set is covered by a whole piece of foam rubber through adhesion, bonding, etc., so as to form a furniture cushion or a desired spring cushion in the form of a furniture cushion. However, the independent bagged spring bed mattress is still an integral product, which is non-disassemble and not easy to transport. In addition, in the independent bagged spring bed mattress, non-woven fabrics used for covering the bagged springs are adhered to each other, so when the bed mattress is squeezed, a plurality of bagged springs cannot move up and down completely independently, thus affecting the comfort of the bed mattress.

In addition, existing bed mattresses also have the disadvantage of being difficult to clean. For a typical bed mattress, generally only the bed cover can be removed, while the sponge part cannot be removed, thus not easy to clean. Even though latex may have a certain anti-mite effect, the sponge part which is difficult to clean will bring great health risks since a bed mattress may usually be used for several years.

Therefore, there is a need for an improved spring cushion, which can be readily disassembled, moved and reassembled, as well as stored in a compact space. The spring cushion is easy to clean and more comfortable.

SUMMARY

In view of the foregoing problems in the prior art, the present disclosure provides a spring module and a spring cushion for furniture. The spring module of the present disclosure has at least following advantages: the spring cushion has a simple structure and is easy to assemble and disassemble; the disassembled spring modules are able to be compressed or stacked and nested one another, which may greatly save storage and transportation space; as compared to a single spring, the spring module has a base and thus is more stable, thereby the spring cushion is more stable in use; an initial pressure of the spring in the spring module can be predetermined and preset as desired, so that the spring module has a desired stiffness, furthermore, spring modules with different stiffness can be arranged at different positions of the spring cushion as desired; the spring modules in the spring cushion can realize compressing and releasing motions that are truly independent of each other, enabling the spring cushion of the present disclosure to have a better comfort compared with the existing bagged spring bed mattresses; sponge layer as well as other layers in the spring cushion is detachable and thus is easy to clean. The spring cushion of the present disclosure can be used for furniture having spring cushions, such as, including but not limited to bed mattresses, sofas, soft pack benches, etc. In addition, the spring cushion of the present disclosure may also be used alone, for example, as a picnic cushion or the like.

In one aspect, the present disclosure provides a spring module for a furniture product, the spring module comprising: a spring; a base having a first spring fixing portion and an end cap locking portion, the first spring fixing portion being configured to detachably fix a first end of the spring; and an end cap comprising: a cap body portion formed with a second spring fixing portion on a side facing the base, the second spring fixing portion being configured to detachably fix a second end of the spring; a locking portion configured to unlockably lock with the end cap locking portion; and a flexible connection portion connecting the cap body portion to the locking portion and located inside the spring in a radial direction of the spring.

According to an embodiment of the present disclosure, the spring is held between the base and the end cap with a predetermined initial compressive force.

According to an embodiment of the present disclosure, the end cap is a one-piece part.

According to an embodiment of the present disclosure, the flexible connection portion comprises two or more flexible straps.

According to an embodiment of the present disclosure, the first spring fixing portion comprises a slot configured to receive the first end of the spring.

According to an embodiment of the present disclosure, the first spring fixing portion comprises a recess configured to receive the first end of the spring.

According to an embodiment of the present disclosure, the first spring fixing portion comprises a first circumferential wall configured to fix the first end of the spring, the first circumferential wall being located outside the first end of the spring in the radial direction of the spring.

According to an embodiment of the present disclosure, the first spring fixing portion further comprises a second circumferential wall configured to fix the first end of the spring, the second circumferential wall being located inside the first end of the spring in the radial direction of the spring so as to detachably fix the first end of the spring between the first circumference wall and second circumferential wall.

According to an embodiment of the present disclosure, the second spring fixing portion comprises a circumferential flange configured to detachably fix the second end of the spring, the circumferential flange being located outside the second end of the spring in the radial direction of the spring.

According to an embodiment of the present disclosure, the spring is a conical spring.

According to an embodiment of the present disclosure, the locking portion comprises a catch protruding toward the base, the end cap locking portion comprises a locking hole, and the catch being configured to be detachably fixed in the locking hole by elastic deformation of the catch.

According to an embodiment of the present disclosure, when the catch is fixed in the locking hole, a tip end of the catch is flush with a bottom surface of the base or recessed relative to the bottom surface of the base.

According to an embodiment of the present disclosure, a notch surrounding the tip end of the catch is formed in the bottom surface of the base facing away from the end cap, a dimension of the notch in the radial direction of the base being greater than that of the tip end of the catch in the radial direction of the base, so that fingers or a tool can be placed into the notch to unlock the catch.

According to an embodiment of the present disclosure, the locking portion comprises a base portion, a neck portion extending from the base portion towards the base, and a latch member located at a tip end of the neck portion and extending substantially parallel to the base portion, the end cap locking portion comprising a locking hole, the latch member and the locking hole being shaped and dimensioned such that the latch member can pass through the locking hole and be locked in or unlocked from the locking hole by rotation.

According to an embodiment of the present disclosure, the latch member is configured to pass through the locking hole in a first orientation relative to the locking hole and to be locked in a different second orientation relative to the locking hole.

According to an embodiment of the present disclosure, a rotation angle of the second orientation with respect to the first orientation is about 90 degrees.

According to an embodiment of the present disclosure, when the latch member is locked by the locking hole, the tip end of the latch member is flush with the bottom surface of the base or recessed relative to the bottom surface of the base.

According to an embodiment of the present disclosure, one or more detent features are provided on the bottom surface of the base proximate to the locking hole, the one or more detent features being configured to prevent the latch member from rotating from the second orientation toward the first orientation.

According to an embodiment of the present disclosure, the circumference of the base portion of the locking portion is provided with a plurality of grooves and/or a plurality of protrusions for facilitating rotation of the locking portion.

In another aspect, the present disclosure provides a spring cushion for a furniture product, the spring cushion comprising: a base fabric comprising a zipper disposed at a periphery of the base fabric; a plurality of spring modules according to the previous embodiment, wherein the base of said spring module is pre-fixed on the base fabric; and a cover fabric whose periphery is provided with a zipper engageable with the zipper of the base fabric so that the cover fabric can be detachably connected to the base fabric, thereby forming a space accommodating the plurality of spring modules.

According to an embodiment of the present disclosure, the spring cushion further comprises a sponge layer, wherein the sponge layer is formed with a plurality of recesses, each recess being configured to receive the cap body portion of a respective end cap.

According to an embodiment of the present disclosure, the spring cushion further comprises one or more pad layers disposed between the sponge layer and the cover fabric.

It is evident that elements or features described in one embodiment above may be used alone or in combination in other embodiments.

BRIEF DESCRIPTION OF THE DRAWINGS

In the drawings, sizes and proportions do not represent the sizes and proportions of actual products. The drawings are merely illustrative, and certain unnecessary elements or features have been omitted for the sake of clarity.

DETAILED DESCRIPTION OF EMBODIMENTS

Next, the spring module and the spring cushion according to the present disclosure will be described in detail with reference to the figures. What are described herein are merely preferred embodiments according to the present disclosure. On the basis of the preferred embodiments, those skilled in the art can envisage other ways of implementing the present disclosure, which also fall within the scope of the present disclosure.

Figure 1A:
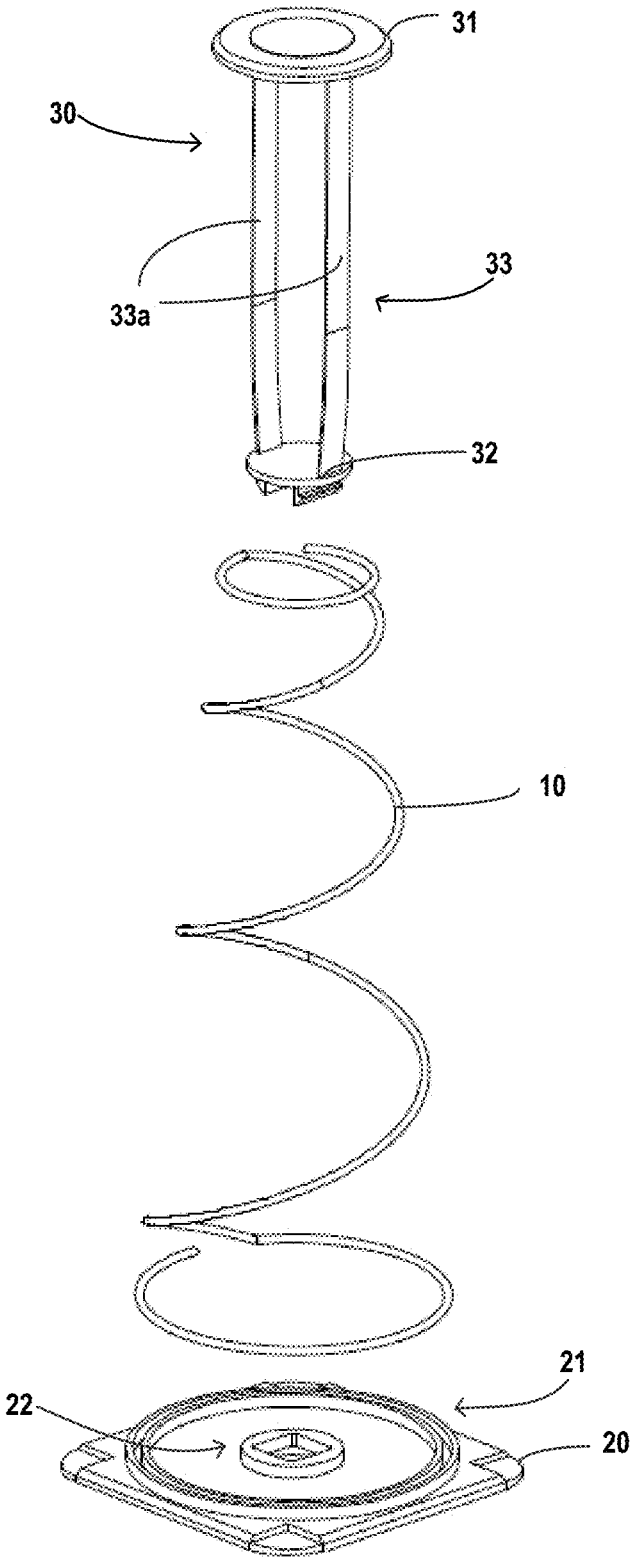
FIG. 1A illustrates an exploded view of a spring module according to an embodiment of the present disclosure.
Figure 1B:
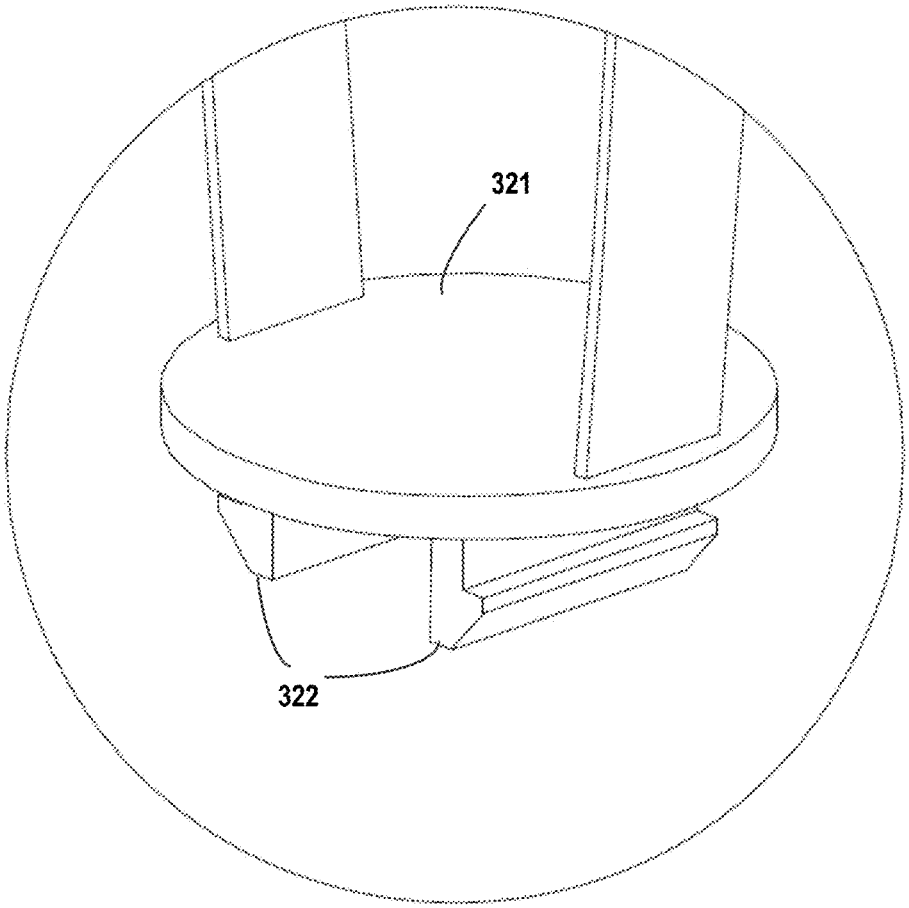
FIG. 1B illustrates an enlarged partial view of the locking portion of the end cap of FIG. 1A.
Figure 1C:
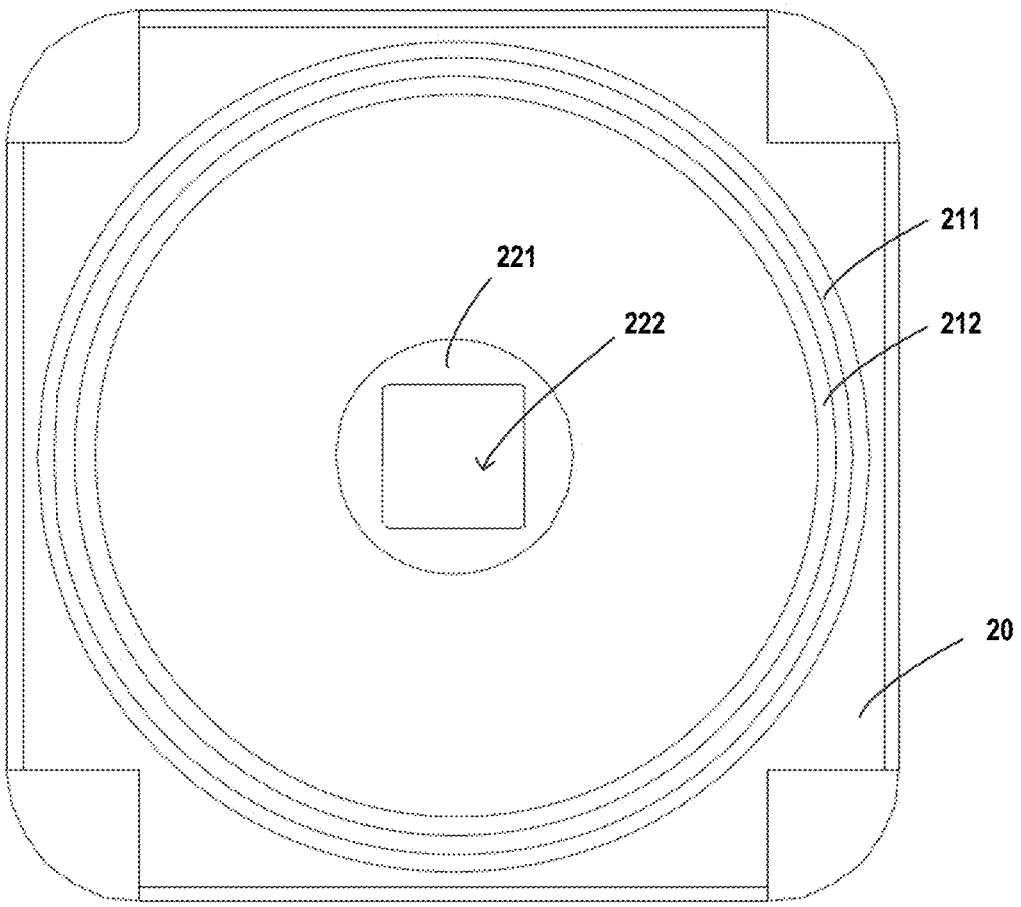
FIG. 1C illustrates a top view of the base in FIG. 1A.

As shown in FIG. 1A, a spring module according to an embodiment of the present disclosure comprises a base 20, a spring 10, and an end cap 30 that can be detachably assembled together to form a spring module, wherein the base 20 and the end cap 30 are both one-piece parts, and may be integrally formed from the same material (e.g., a plastic material), or formed as one-piece parts by ultrasonic welding or the like from a plurality of parts. Specifically, the base 20 is provided with a spring fixing portion 21 for detachably holding one end of the spring 10 and an end cap locking portion 22 for detachably fixing the end cap 30. The end cap 30 comprises a cap body portion 31, a locking portion 32 and a flexible connection portion 33 connecting the cap body portion 31 to the locking portion 32. The cap body portion 31 is formed with a spring fixing portion 311 for detachably holding the other end of the spring 10 on a side of the cap body portion 31 facing the base 20. The locking portion 32 is configured to unlockably lock with the end cap locking portion 22. For example, as shown in FIG. 1B and FIG. 1C, the locking portion 32 may include a base portion 321 and a catch 322 extending downward from a bottom surface of the base portion 321. The end cap locking portion 22 may comprise a boss 221 and a locking hole 222 formed in the boss 221. When assembling the spring module, the locking portion 32 may be aligned with the locking hole 222 and then the base portion 321 of the locking portion 32 may be pressed toward the locking hole 222 to cause the catch 322 to elastically deform and pass through the locking hole 222. After passing through the locking hole 222, the catch 322 returns to its original shape so as to be detachably fixed in the locking hole 222, thereby fixing the spring 10 between the base 20 and the end cap 30, thereby forming the spring module. Preferably, the spring 10 in the spring module has a predetermined initial compressive force to create a desired comfortable stiffness. The locking hole 222 shown in FIG. 1B and FIG. 1C is rectangular and, accordingly, the catch 322 is of a linear configuration. Such an arrangement may prevent, to some extent, rotation of the end cap 30 relative to the base 20. In other embodiments of the present disclosure, the locking hole 222 may be in other shapes such as circular, and the catch 322 may be arc-shaped. Such a structure facilitates the assembling more.

Figure 2A:
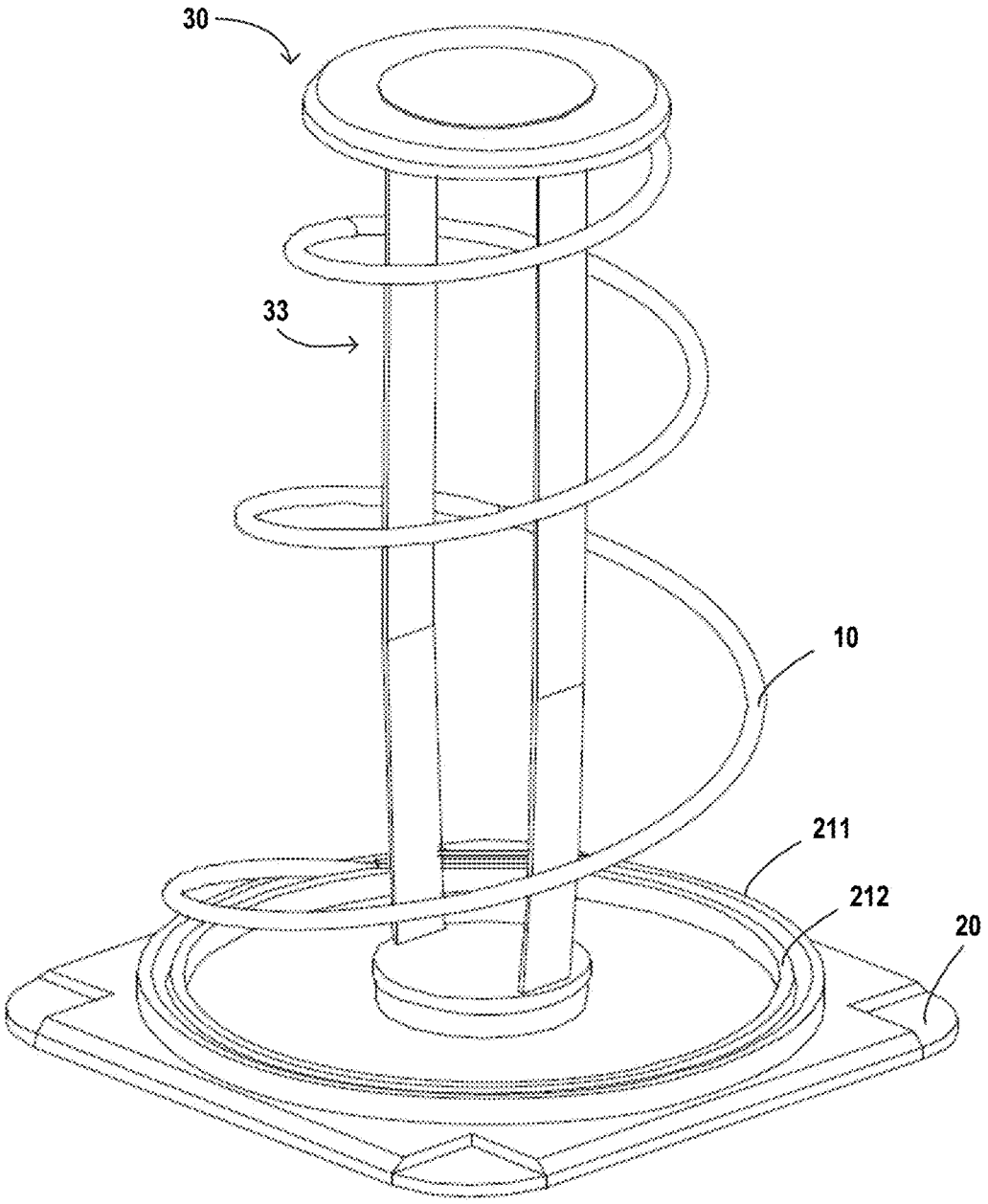
FIG. 2A illustrates an assembled state of the spring module of FIG. 1A.
Figure 3A:
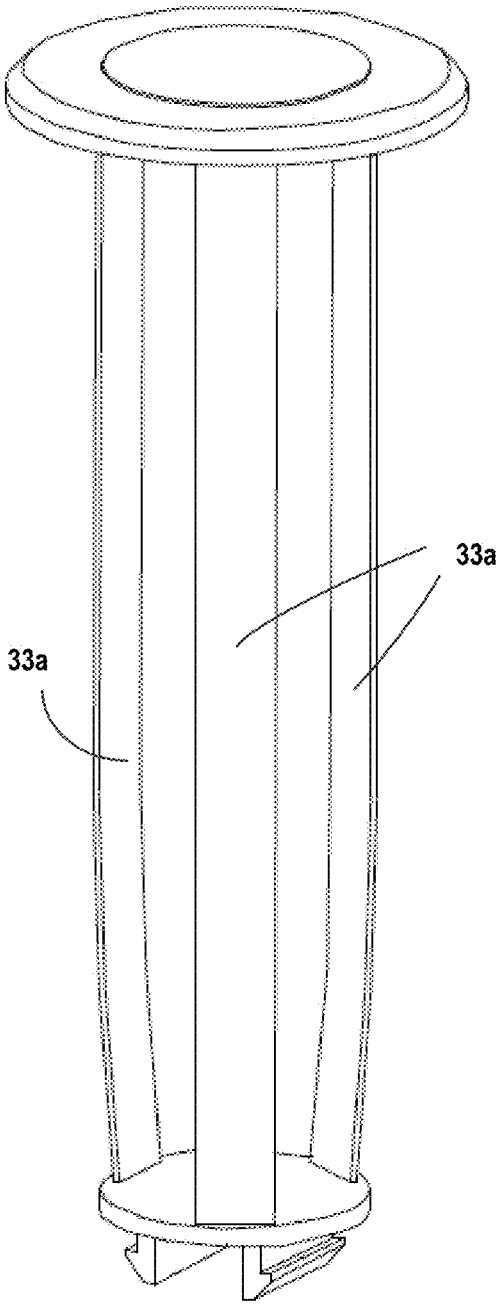
FIG. 3A illustrates an end cap according to another embodiment of the present disclosure.
Figure 3B:
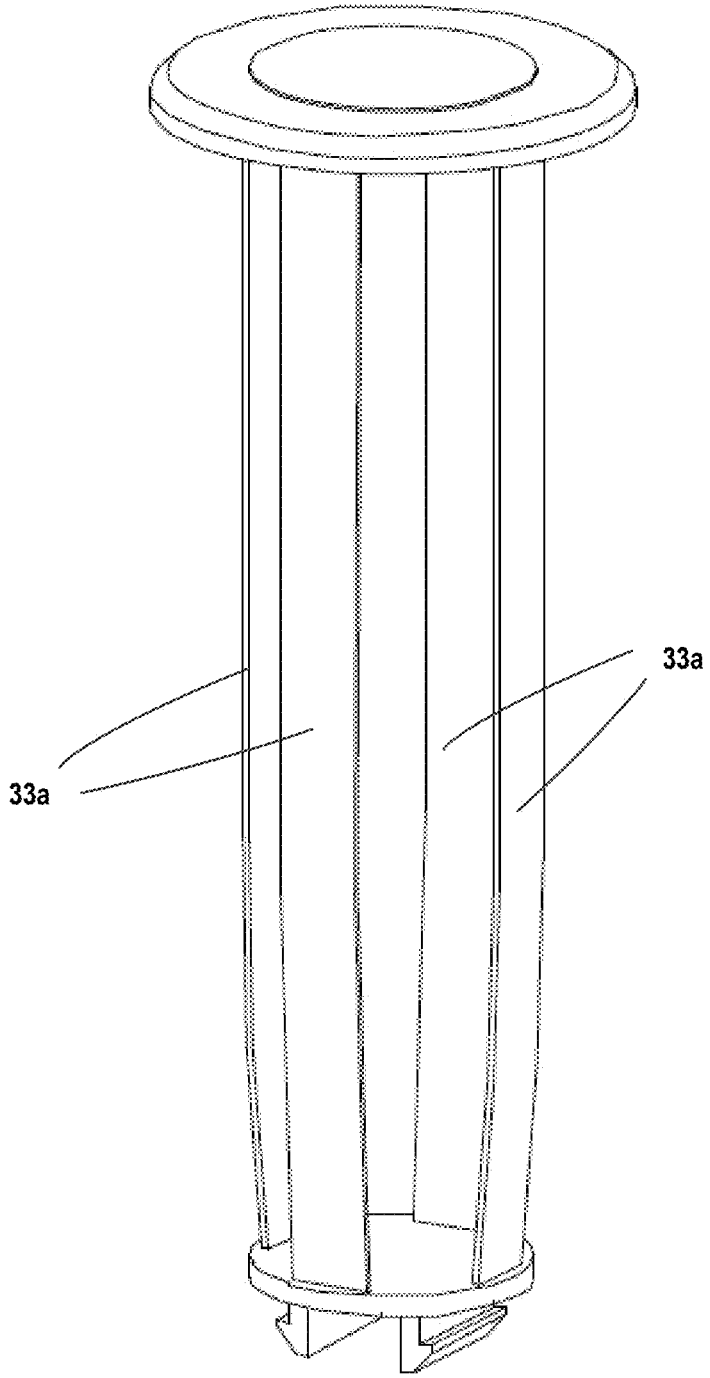
FIG. 3B illustrates an end cap according to a further embodiment of the present disclosure.

As shown in FIG. 2A, in the spring module in the assembled state, the flexible connecting portion 33 is located inside the spring 10 in a radial direction of the spring 10, and a lower surface of the base portion 321 engages with an upper surface of the boss 221 to make the connection between the end cap 30 and the base 20 more stable and prevent the locking portion 32 and flexible straps 33*a* from further passing through the locking hole 222. The boss 221 may be omitted in other embodiments of the present disclosure. The flexible connection portion 33 will deform adaptively when the spring module is subjected to pressure such that the spring 10 is compressed. Preferably, the flexible connection portion 33 comprises flexible straps 33*a*. Although two flexible straps 33*a* are shown in the figure, one skilled in the art will appreciate that the flexible connection portion 33 may include more flexible straps 33*a*, such as three flexible straps 33*a* shown in FIG. 3A and four flexible straps 33*a* shown in FIG. 3B.

The spring fixing portion 21 on the base 20 may be a slot, recess, or other form. For example, as shown in FIGS. 1C and 2A, the spring fixing portion 21 may be in the form of a circumferential wall 211 sized to closely abut against the outside of a lower end of the spring 10 to restrain the lower end of the spring 10 in a radially outward direction. Further, the spring fixing portion 21 may further comprise another circumferential wall 212 sized to closely abut against the lower end of the spring 10 to restrain the lower end of the spring 10 in a radially inward direction.

The spring fixing portion 311 on the cap body portion 31 may be a slot, recess, or other form. For example, as shown in FIG. 2D, the spring fixing portion 311 may be a circumferential flange which is around the circumference of the cap body portion 31, and closely abuts against the outside of a top end of the spring 10. Similarly, the spring fixing portion 311 may further include a circumferential wall inside the top end of the spring.

Figure 2B:
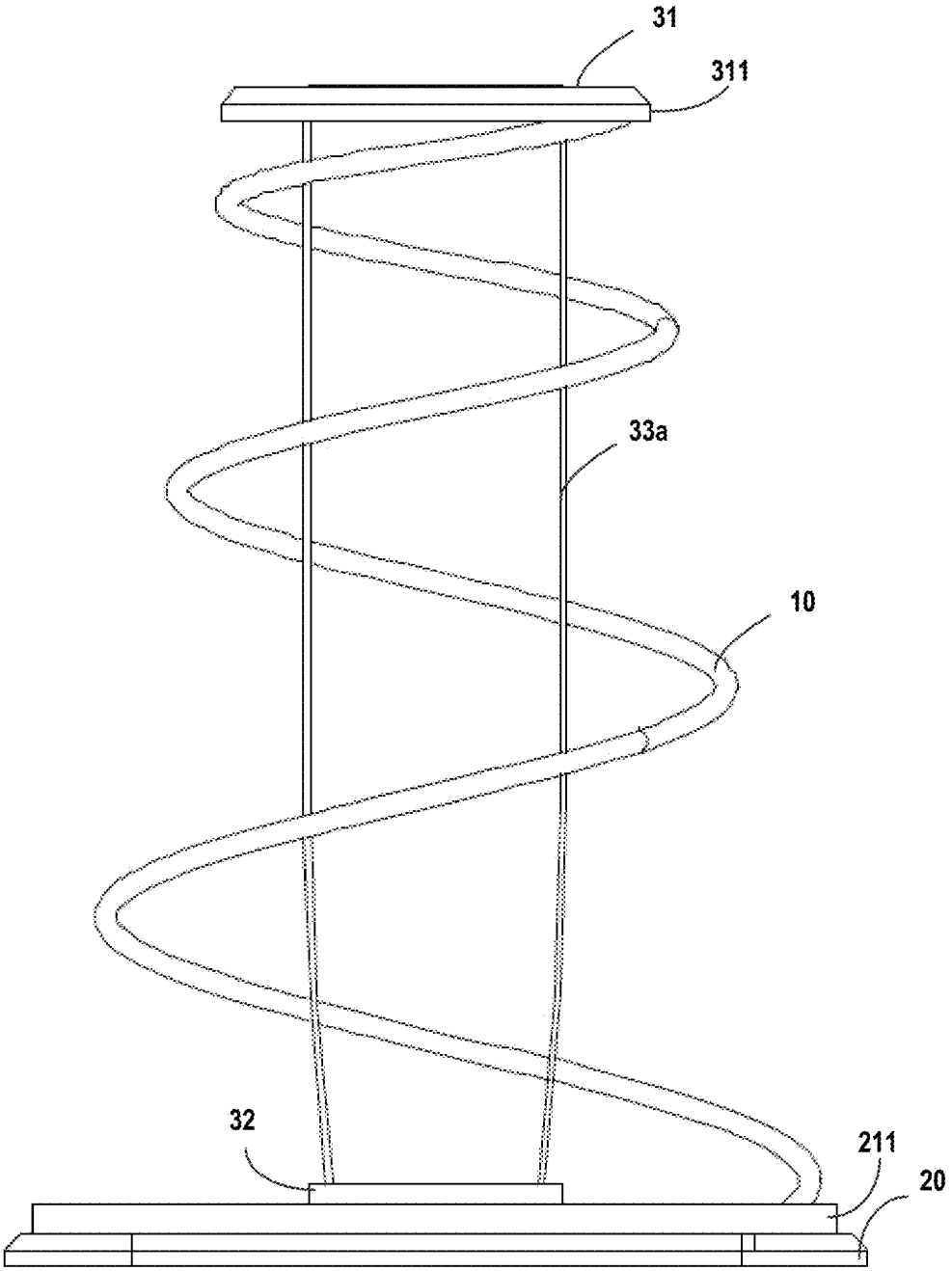
FIG. 2B illustrates a side view of the spring module of FIG. 2A.
Figure 2C:
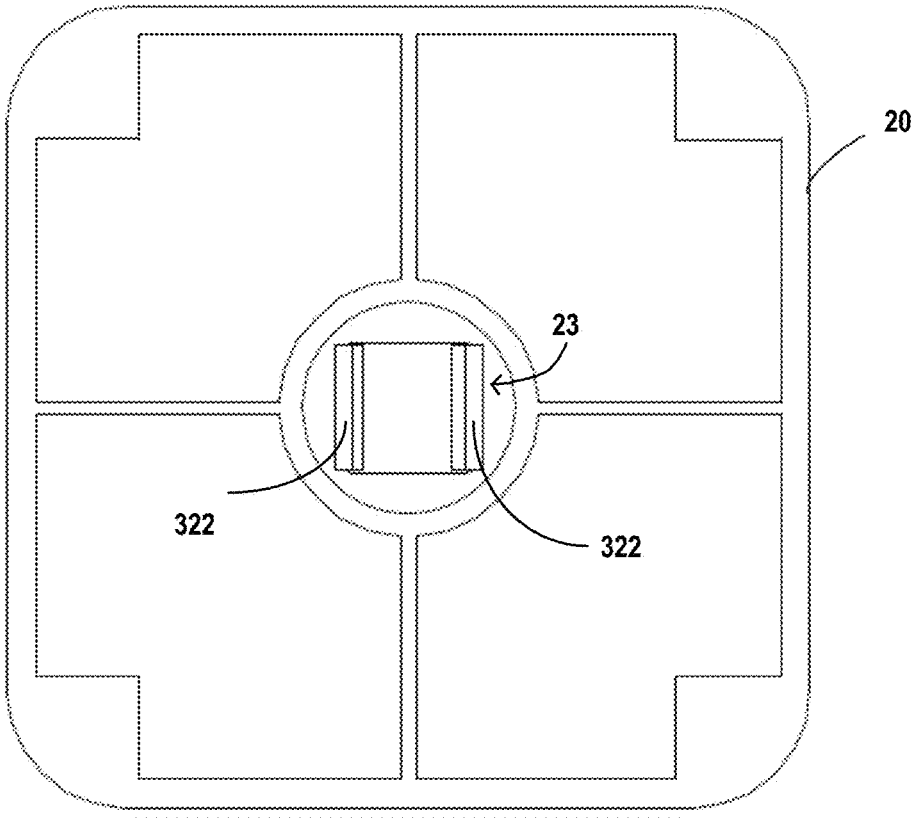
FIG. 2C illustrates a bottom view of the spring module of FIG. 2A.
Figure 2D:
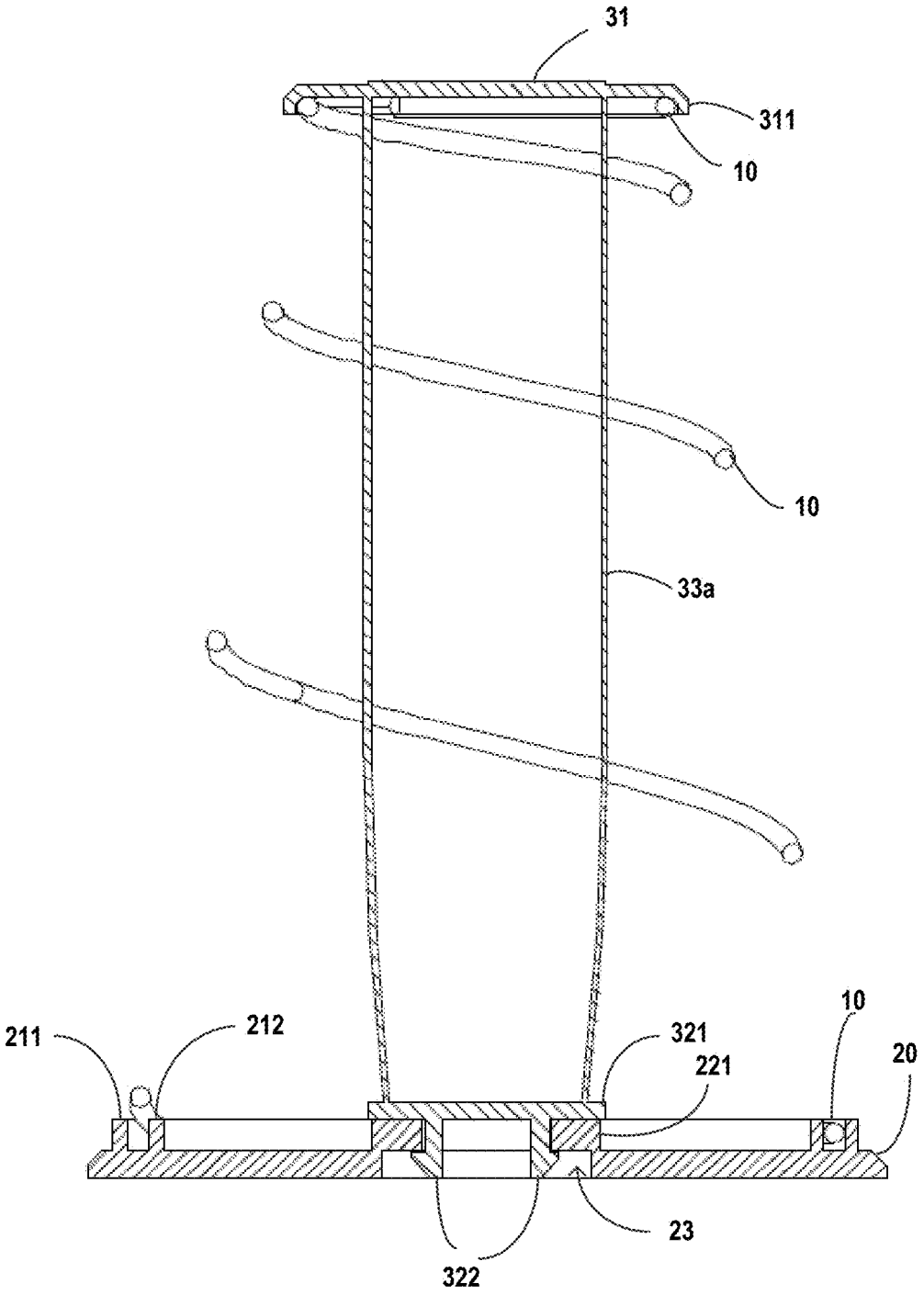
FIG. 2D illustrates a cross-sectional view of the spring module of FIG. 2A.

With further reference to FIGS. 2B and 2D, when the catch 322 is mounted in the locking hole 222, a lower end of the catch 322 is flush with the bottom surface of the base 20 or upwardly recessed relative to the bottom surface of the base 20 to facilitate stable arrangement of the base 20.

As shown in FIGS. 2C and 2D, a recess or depression 23 is formed in the bottom surface of the base 20 around the tip end of the catch 322, a radial dimension of the recess 23 is greater than the dimension of the tip end of the catch 322 in the radial direction of said base 20, thereby forming an operating space around the catch 322 to facilitate the insertion of fingers or a tool into the recess 23 to unlock the catch 322.

FIGS. 4A-5B illustrate a spring module according to another embodiment of the present disclosure, which is substantially similar to the previously described spring module. The spring module comprises a base 60, a spring 10, and an end cap 70 that can be detachably assembled together to form the spring module, wherein the base 60 and the end cap 70 are both one-piece parts, and may be integrally formed from the same material (e.g., a plastic material), or formed as one-piece parts by ultrasonic welding or the like from a plurality of parts. In this embodiment, the same or similar features are denoted by the same or similar reference numerals, and the similarities to the foregoing embodiment will not be described in detail any more. This embodiment differs from the previous embodiment in a locking portion 72 of the end cap 70 and an end cap locking portion 62 disposed on the base 60 for locking the end cap. As shown, the locking portion 72 may comprise a base portion 721 and a latch member 722 extending downward from a bottom surface of the base portion 721. The end cap locking portion 62 may comprise a boss 621 and a locking hole 622 formed in the boss 621, the latch member 722 and the locking hole 622 are shaped to in a way that the latch member 722 can be locked into and unlocked from the locking hole by rotating the latch member 722 relative to the locking hole 622. For example, as shown in FIGS. 4B and 4C, the latch member 722 may be an elongated member extending generally parallel to the base portion 721, and there is a neck portion of reduced dimension between the latch member 722 and the base portion 721. The locking hole 622 may have a shape corresponding to the shape of the latch member 722, and be sized slightly greater than the latch member 722 to facilitate passage of the latch member 722 therethrough. When assembling the spring module, the orientation of the latch member 722 may be adjusted to enable the latch member 722 to align with the locking hole 622 such that the latch member 722 passes through the locking hole 622 in that orientation. The latch member 722 may then be rotated (e.g., 90 degrees) to lock against an underside of base portion 60, thereby securing spring 10 between base 60 and the end cap 70. Preferably, the spring 10 in the spring module has a predetermined initial compressive force to create a stiffness with desire comfort.

Figure 5A:
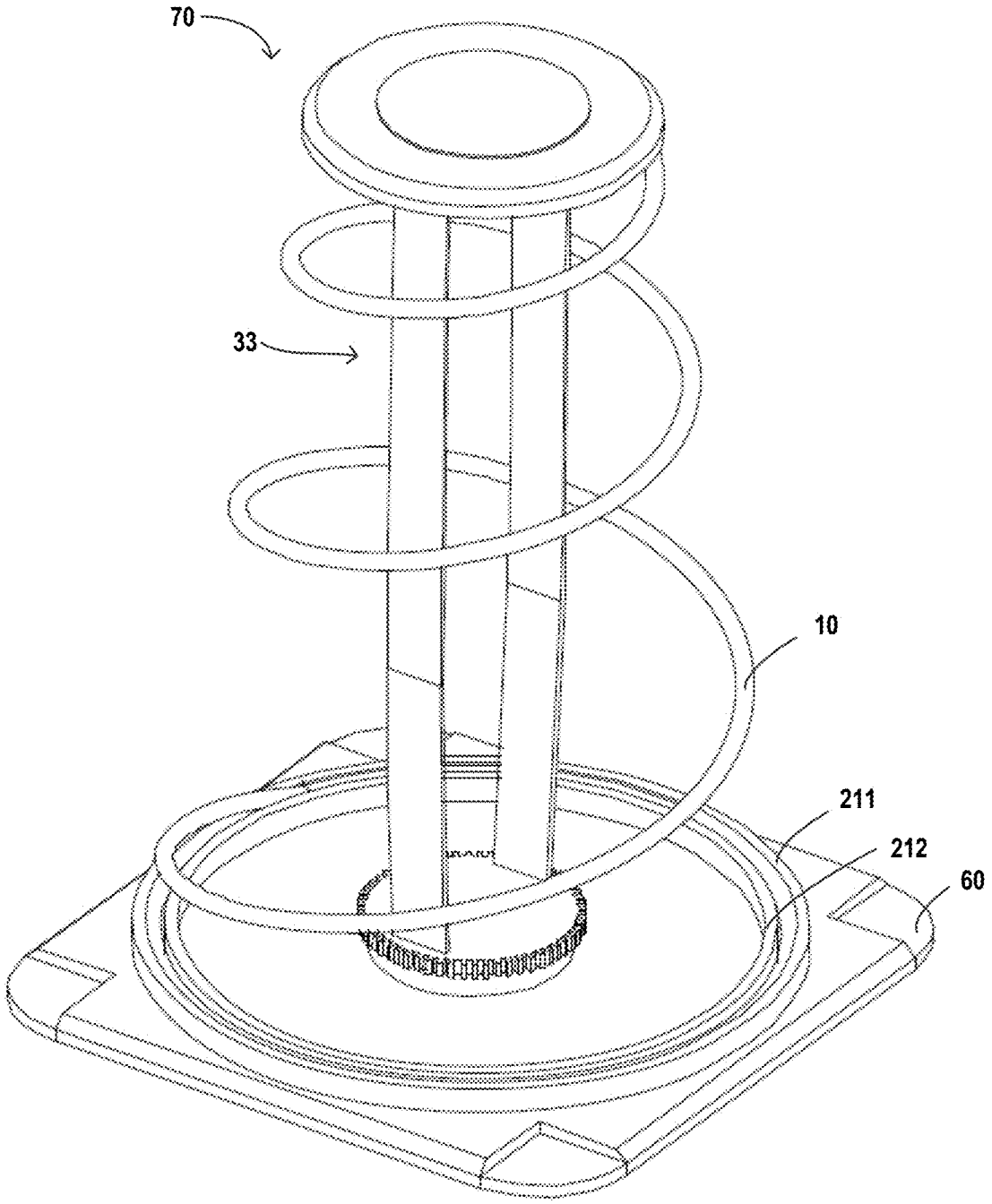
FIG. 5A illustrates an assembled state of the spring module of FIG. 4A.
Figure 5B:
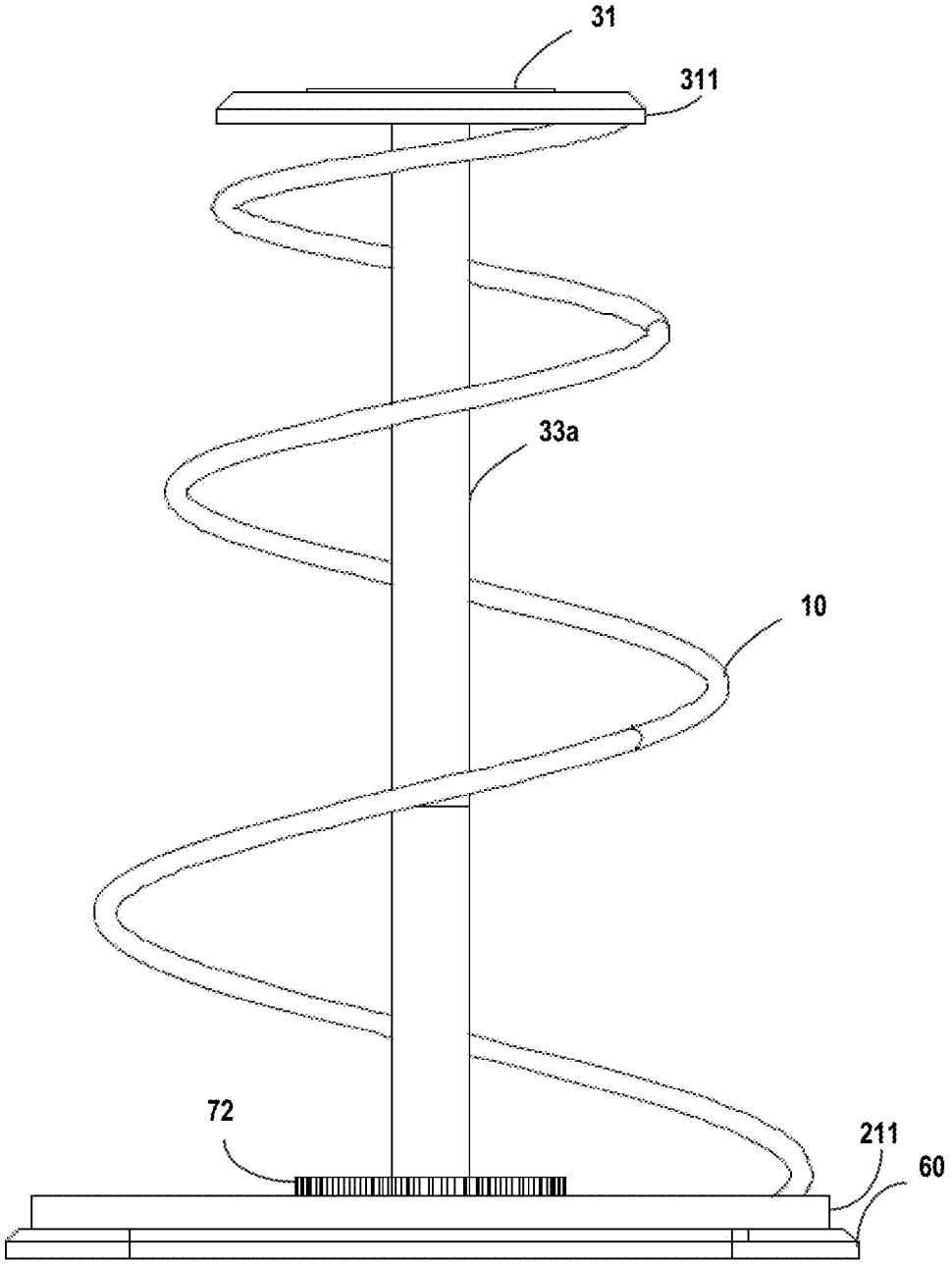
FIG. 5B illustrates a side view of the spring module of FIG. 5A.
Figure 6A:
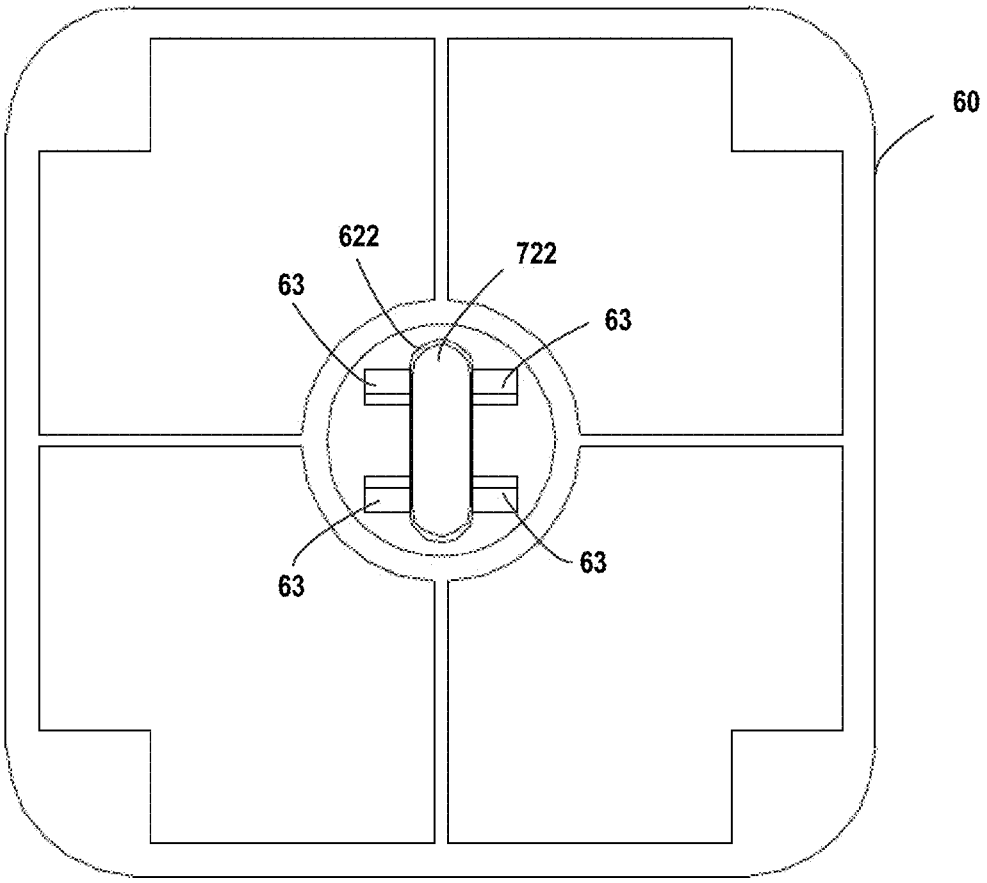
FIG. 6A illustrates a bottom view of the spring module of FIG. 5A with a latch member being in a first orientation.
Figure 6B:
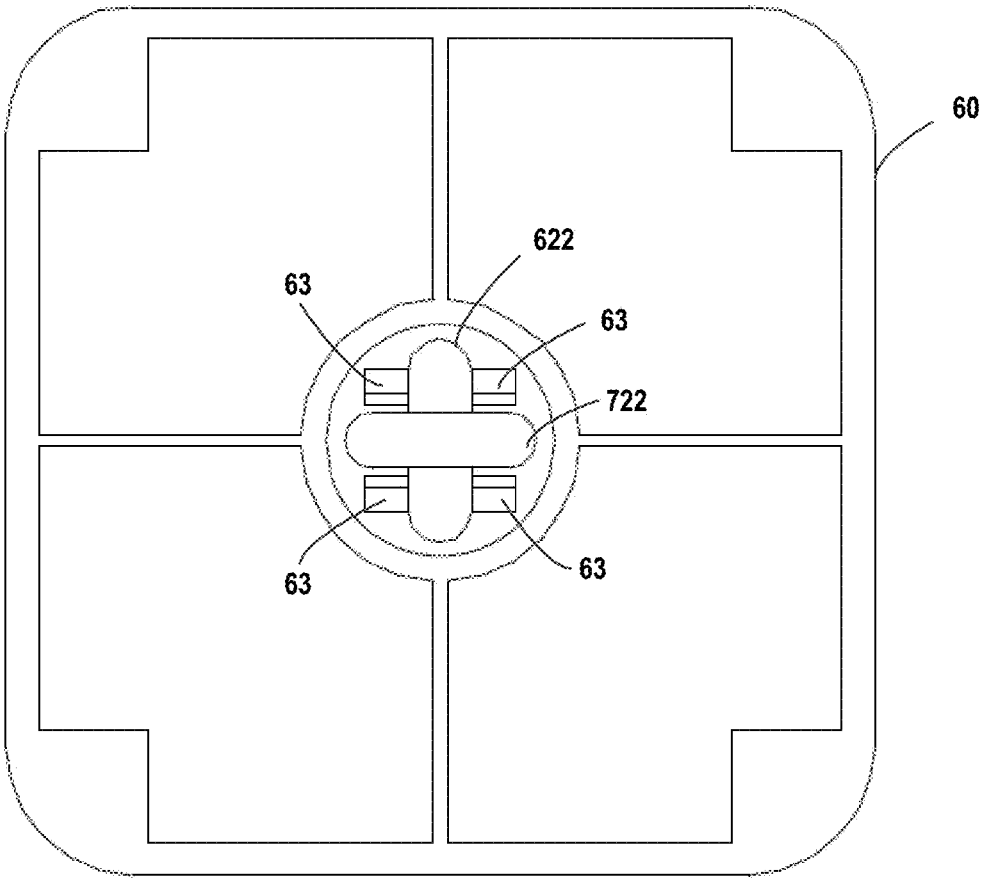
FIG. 6B illustrates a bottom view of the spring module of FIG. 5A with the latch member being in a second orientation.

As shown in FIGS. 5A and 5B, in the assembled spring module, the flexible connecting portion 33 is located radially inside the spring 10, and a lower surface of the base portion 721 engages an upper surface of the boss 621 to make the connection between the end cap 70 and the base 60 more stable and prevent the locking portion 72 and the flexible straps 33*a* from further passing through the locking hole 622. The boss 621 may be omitted in other embodiments of the present disclosure.

FIGS. 5A and 5B are bottom views, wherein FIG. 5A shows the latch member 722 passing through the locking hole 622 in a first orientation, and FIG. 5B shows the latch member 722 in a second orientation after being rotated through an angle (e.g., about 90 degrees). In order to prevent the latch member 722 in the locked state from rotating and accidentally unlocking from the base 60, one or more detent features or stop protrusions 63 may be provided proximate to the lower side of the locking hole 622 of the base 60 to keep the latch member 722 in the locked orientation (i.e., the second orientation).

With further reference to FIG. 5B, when the latch member 722 is secured in the locking hole 622, the lower end of the latch member 722 is flush with the bottom surface of the base 60 or upwardly-recessed relative to the bottom surface of the base 60 to facilitate stable arrangement of the base 60.

Figure 4A:
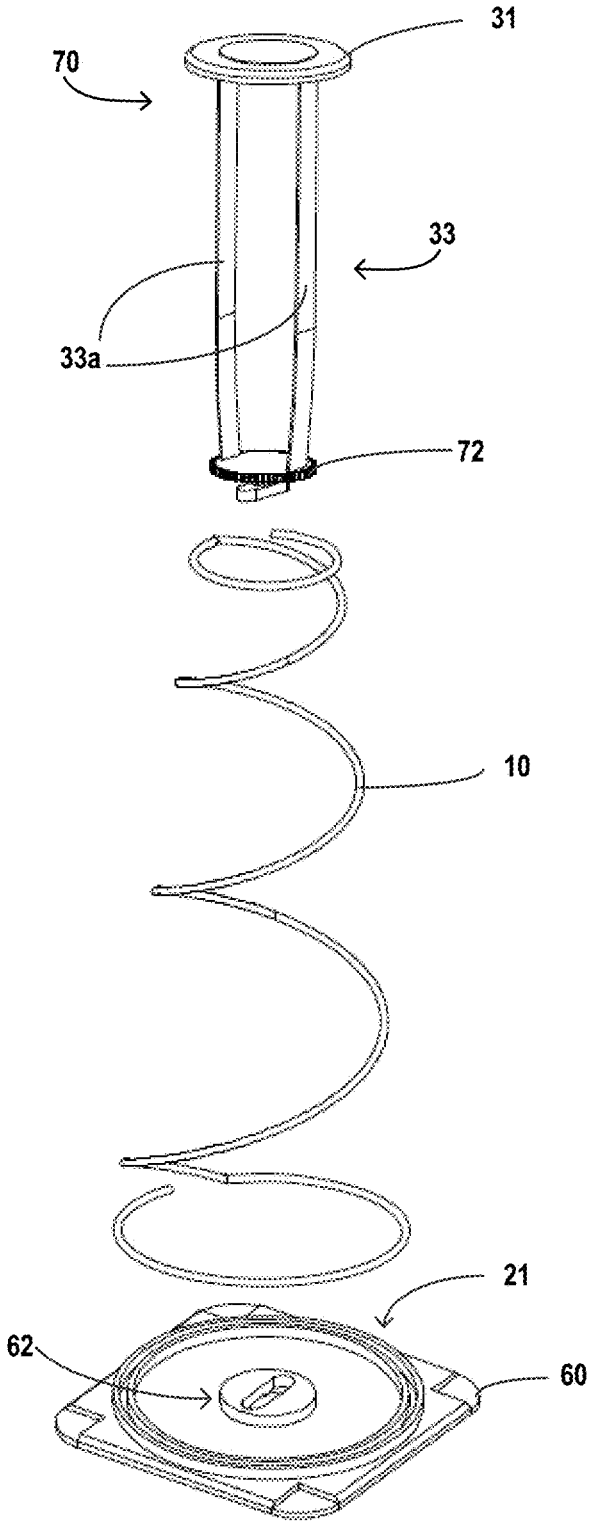
FIG. 4A illustrates an exploded view of a spring module according to another embodiment of the present disclosure.
Figure 4B:
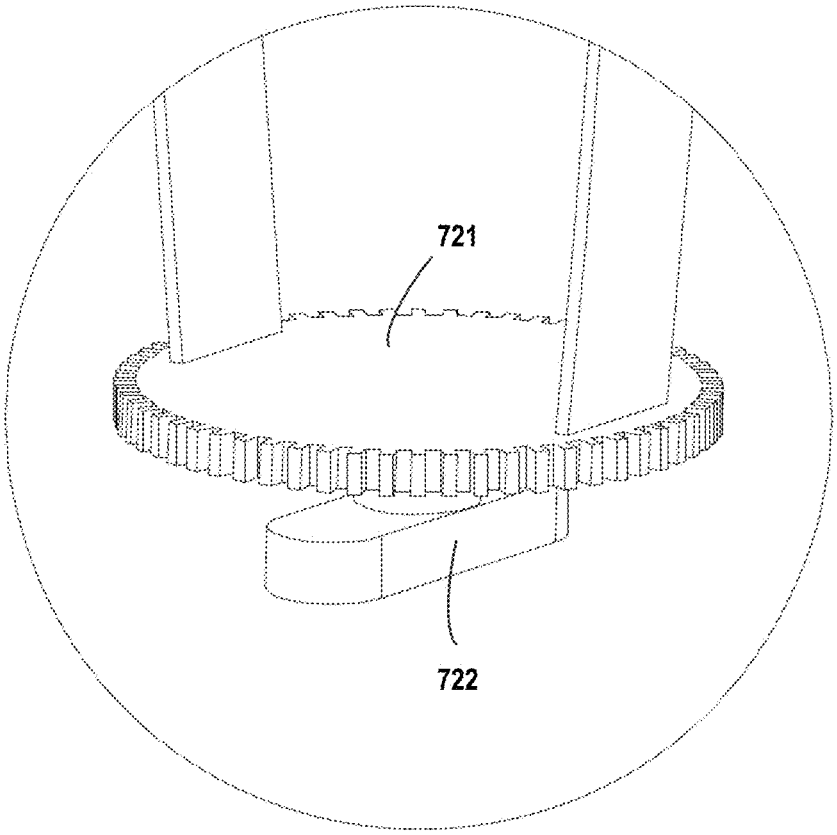
FIG. 4B illustrates a partially enlarged view of a locking portion of the end cap of FIG. 4A.
Figure 4C:
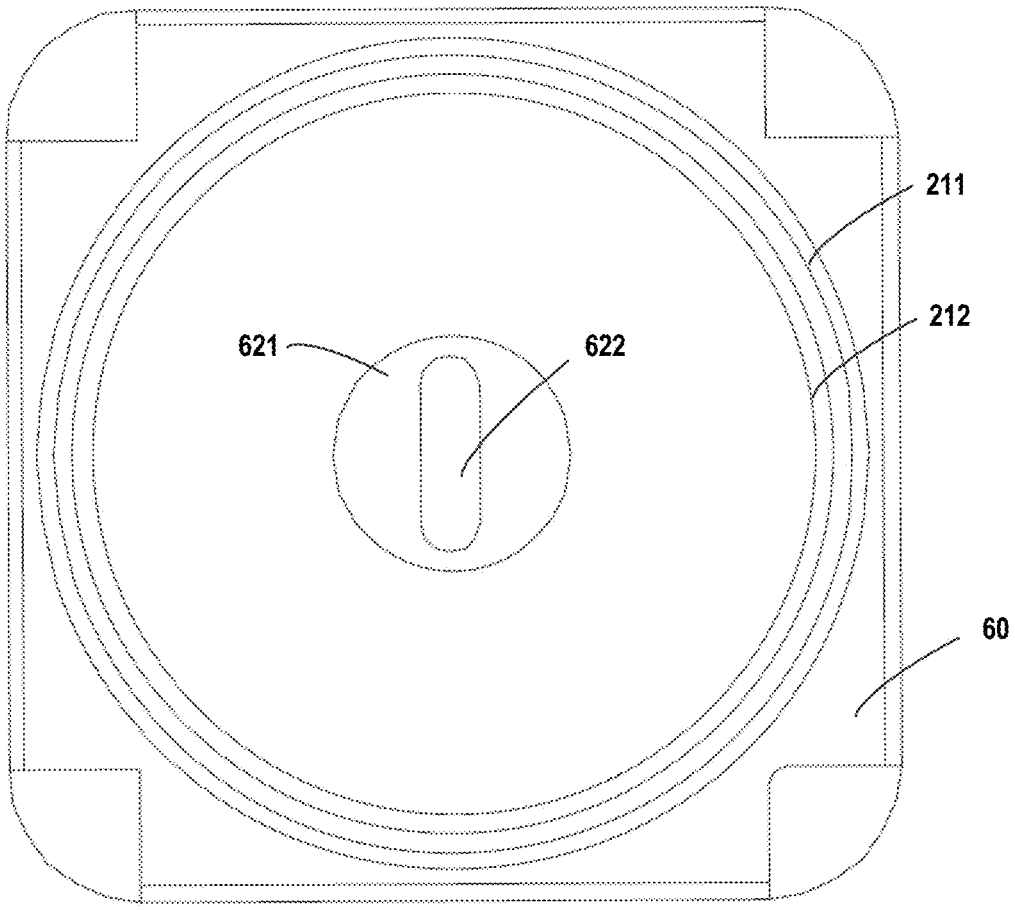
FIG. 4C illustrates a top view of the base of FIG. 4A.

To facilitate rotation of the locking portion 72, the circumference of the base portion 721 may be provided with a plurality of grooves and/or a plurality of protrusions, as shown in FIG. 4B.

FIGS. 7A to 7F show a spring cushion according to the present disclosure. A plurality of bases as described above are pre-fixed to a base fabric 80 by bonding, ultrasonic welding, riveting, or the like. Although the bases 20 are shown, they may also be replaced with the bases 60 as described above. After purchasing the product, a consumer may assemble the mattress by himself by directly fixing the plurality of springs 10 and the plurality of end caps 30 or 70 to the respective bases 20 or 60 on the base fabric 80.

Figure 7A:
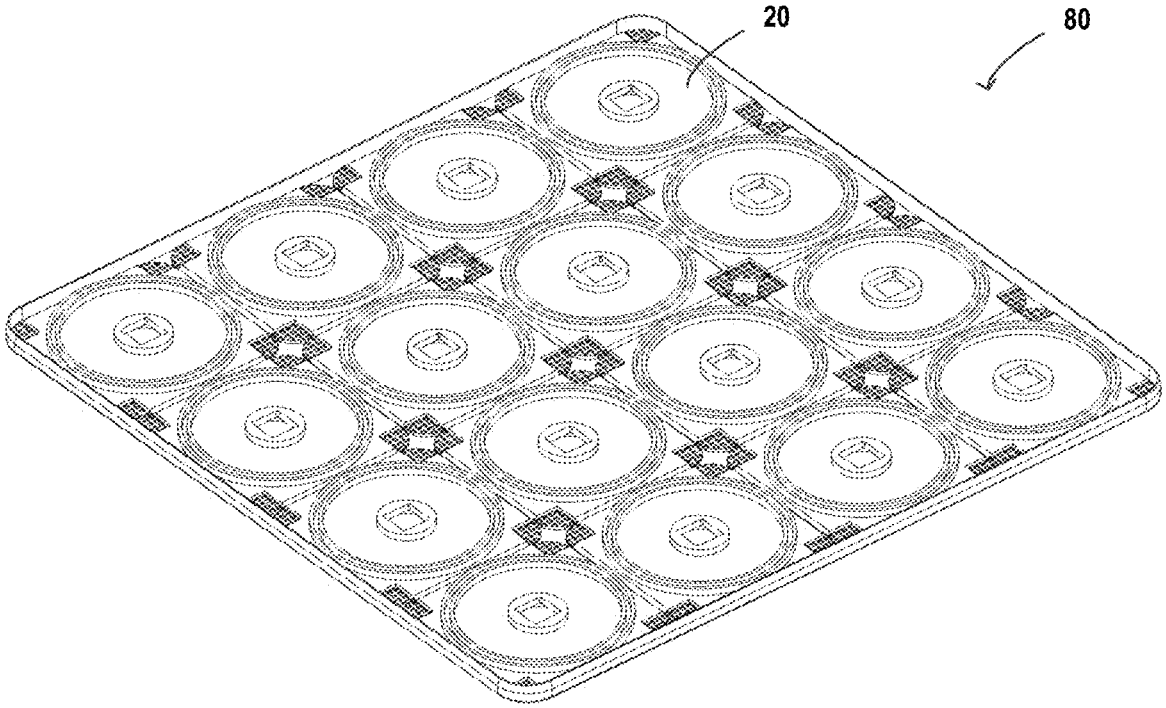
FIG. 7A illustrates a base fabric of a spring cushion according to an embodiment of the present disclosure.
Figure 7B:
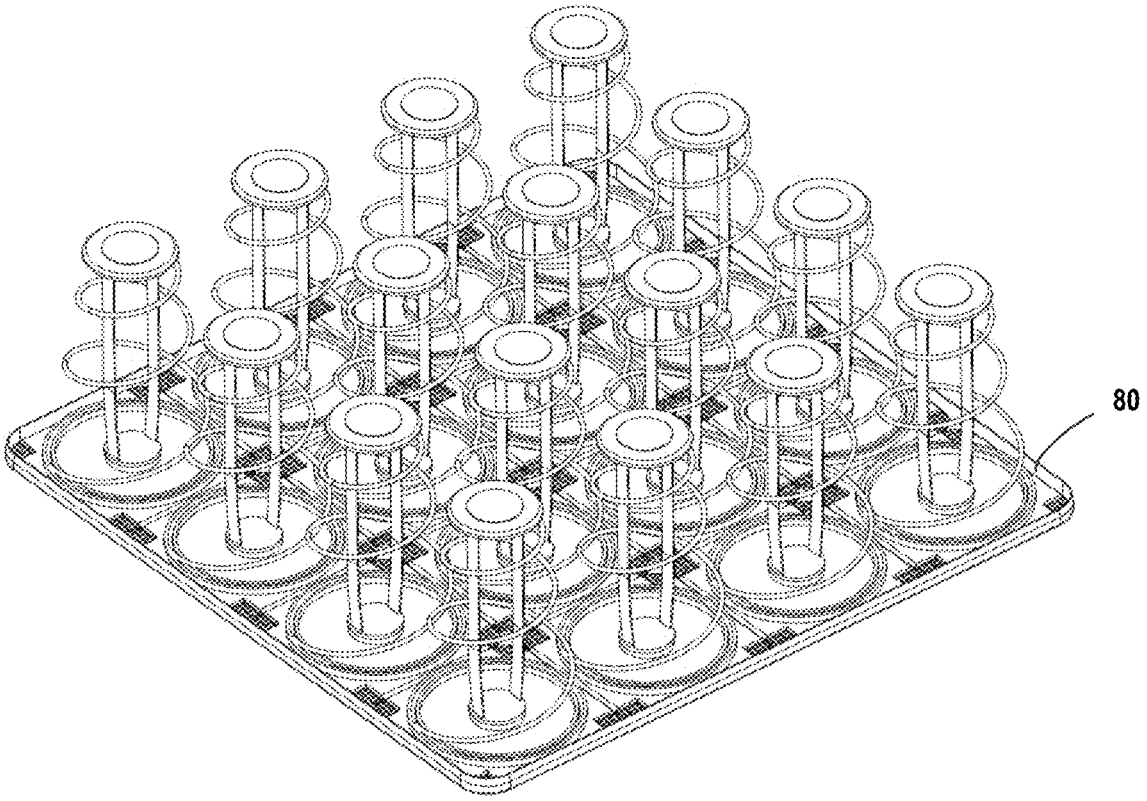
FIG. 7B illustrates that springs and end caps are assembled on the base fabric of FIG. 7A.
Figure 7C:
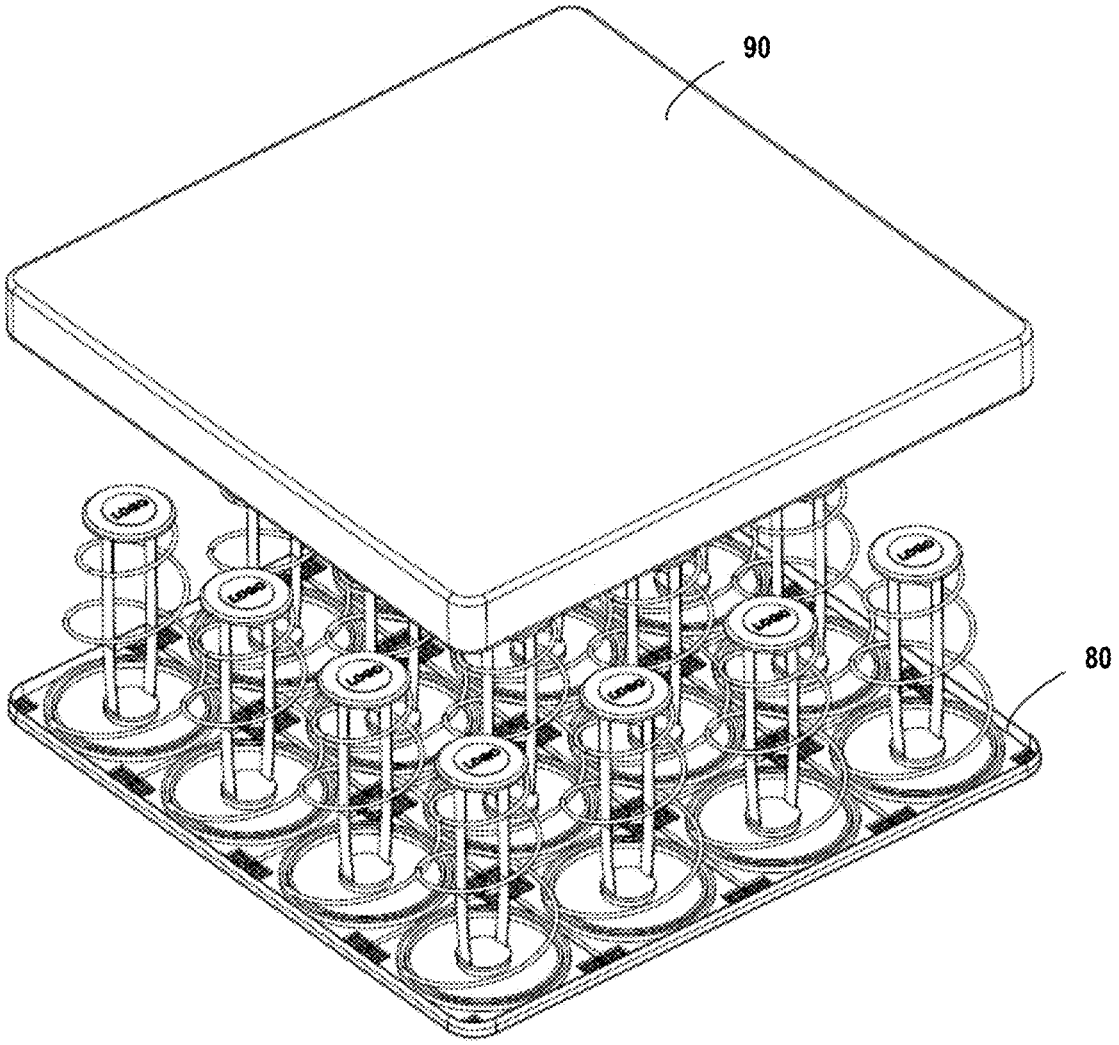
FIG. 7C illustrates a sponge layer for the spring cushion.
Figure 7D:
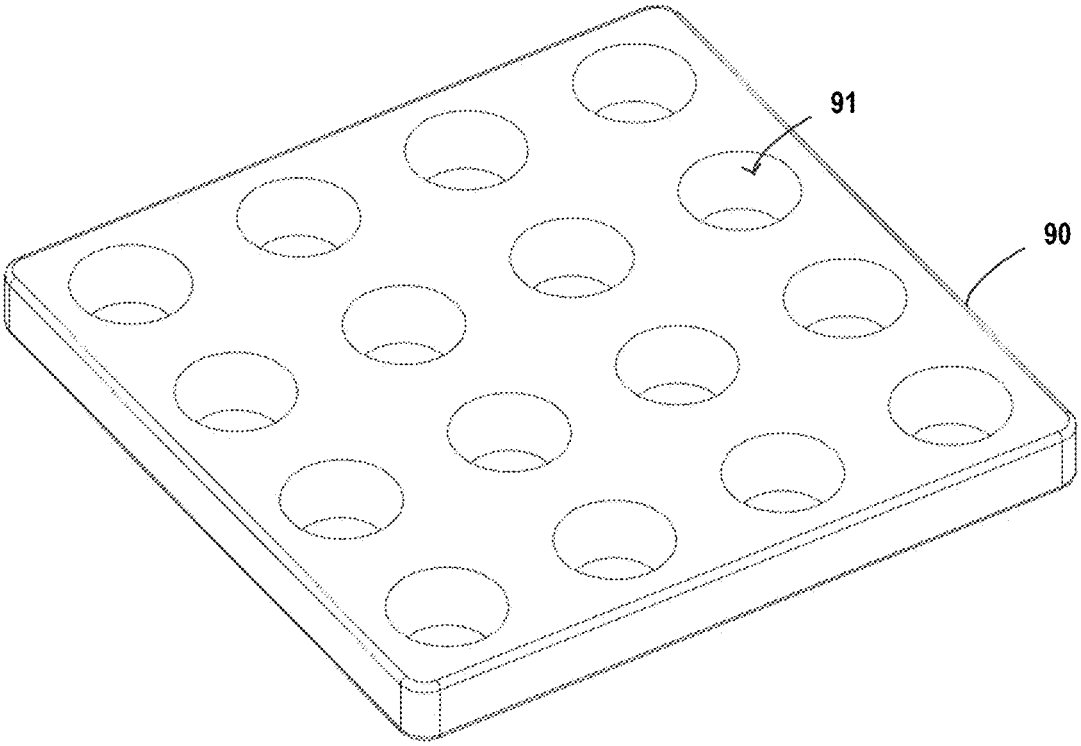
FIG. 7D illustrates a bottom side of the sponge layer of FIG. 7C.
Figure 7E:
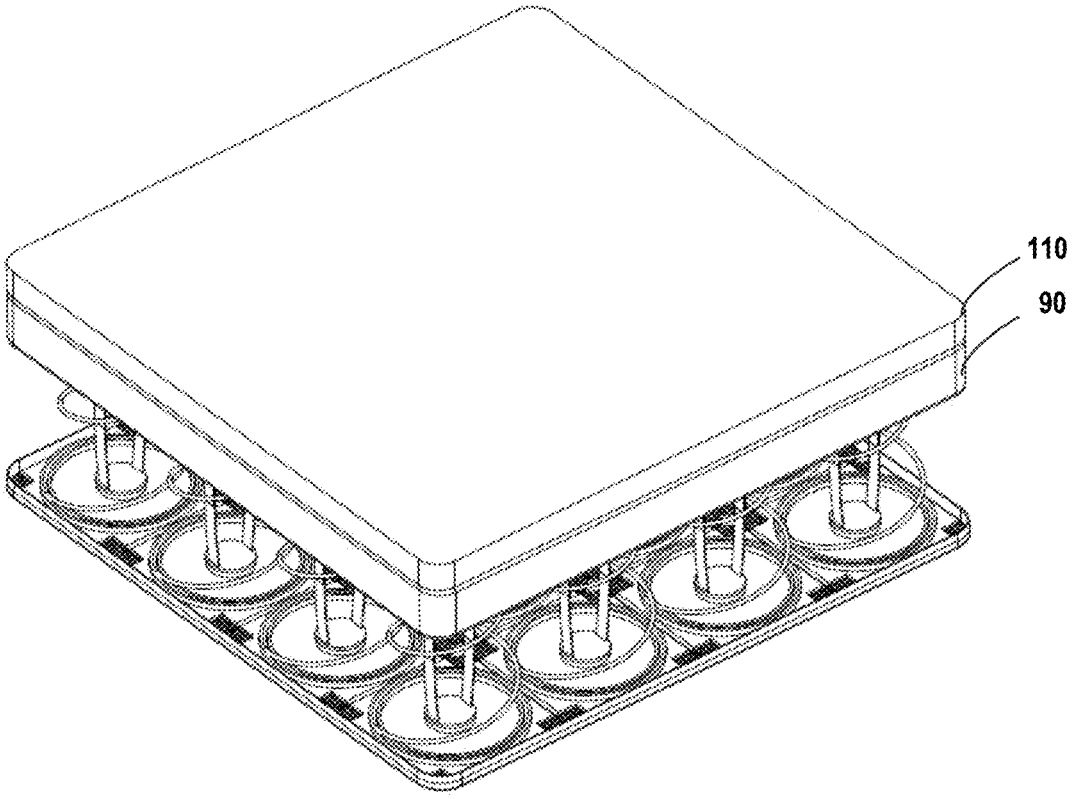
FIG. 7E illustrates other pad layers for the spring cushion.

With further reference to FIGS. 7C and 7D, in order to increase the comfort of the spring cushion and the stability of the spring modules, a sponge layer 90 may be provided on top of the spring modules. The sponge layer 90 is provided with a plurality of recesses 91 on the side facing the spring modules, each recess 91 being capable of receiving a top end portion of the spring module comprising the cap body portion 31 or 71.

Figure 7F:
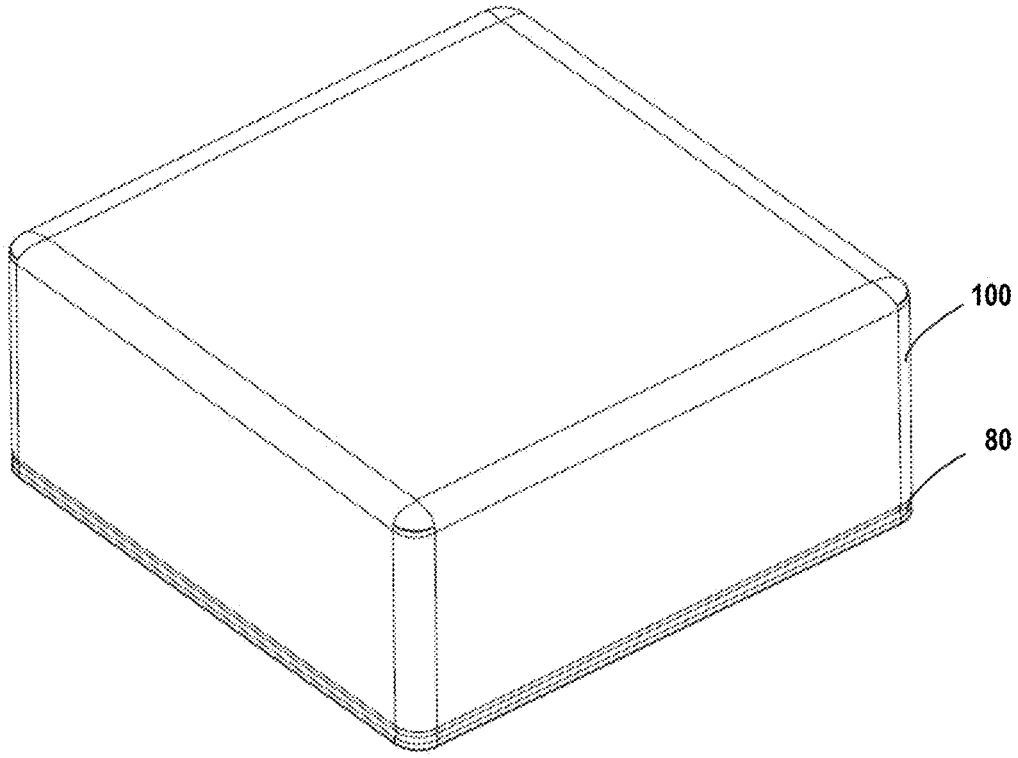
FIG. 7F illustrates a spring cushion according to an embodiment of the present disclosure.

As shown in FIG. 7F, the spring module further comprises a cover fabric 100. A Zipper is disposed at the periphery of both the cover fabric 100 and the base fabric 80 so that the cover fabric 100 can be detachably connected to the base fabric 80, thereby forming an enclosed space accommodating a plurality of spring modules.

To further improve the comfort of the spring cushion, one or more identical or different pad layers may be additionally disposed between the sponge layer 90 and the cover fabric 100 as needed.

Although the spring 10 is shown as a conical spring, it will be appreciated by those skilled in the art that the spring module according to the present disclosure may include other forms of springs, such as cylindrical springs or the like, by adjusting the radial dimensions of the base 20 and end cap 30 or the dimensions of the spring fixing portions.

The scope of the present disclosure is defined only by the claims. Those skilled in the art, having the benefit of the teachings of the present disclosure, will readily recognize that alternative structures to the structures disclosed herein may be regarded as feasible alternative embodiments, and that the embodiments disclosed herein may be combined as new embodiments that also fall within the scope of the appended claims.

I claim:

1. A spring module for a furniture product, comprising:

a spring;

a base having a first spring attaching portion and a base locking portion, wherein the first spring attaching portion is configured to releasably attach a first end of the spring; and an end cap including:

a cap body having a second spring attaching portion configured to releasably attach a second end of the spring;

an end cap locking portion configured to lock and unlock with the base locking portion; and a flexible connector connecting the cap body to the end cap locking portion radially inside of the spring;

wherein the cap body, the end locking portion, and the flexible connector are formed as a single part and are configured to be detachably mounted to the base.

2. The spring module of claim 1, wherein the spring is a conical spring held between the base and the end cap with a predetermined initial compressive force.

3. The spring module of claim 1, wherein the flexible connector comprises two or more flexible straps.

4. The spring module of claim 1, wherein the first spring attaching portion comprises a slot configured to receive the first end of the spring.

5. The spring module of claim 1, wherein the first spring attaching portion comprises a recess configured to receive the first end of the spring.

6. The spring module of claim 1, wherein the first spring attaching portion comprises a first circumferential wall configured to attach the first end of the spring, the first circumferential wall located radially outside of the first end of the spring.

7. The spring module of claim 6, wherein the first spring attaching portion further comprises a second circumferential wall configured to attach the first end of the spring, the second circumferential wall located radially inside of the first end of the spring, to releasably secure the first end of the spring between the first circumference wall and second circumferential wall.

8. The spring module of claim 1, wherein the second spring attaching portion comprises a circumferential flange configured to releasably attach to the second end of the spring, with the circumferential flange radially outside the second end of the spring.

9. The spring module of claim 1, wherein the end cap locking portion comprises a catch protruding toward the base, the base locking portion comprising a locking hole, and the catch configured to engage into and release from the locking hole by elastic deformation of the catch.

10. The spring module of claim 9, wherein when the catch is fixed in the locking hole, an end tip of the catch is flush with a bottom surface of the base or recessed relative to the bottom surface of the base.

11. The spring module of claim 10, wherein a notch surrounding the end tip of the catch is formed in the bottom surface of the base, the notch providing clearance so that fingers or a tool can be placed in the notch to unlock the catch.

12. The spring module of claim 1, wherein the end cap locking portion comprises a base portion, a neck portion extending from the base portion towards the base, and a latch member located at an end tip of the neck portion and extending substantially parallel to the base portion, the base locking portion comprising a locking hole, the latch member and the locking hole configured to allow the latch member to pass through the locking hole and be locked in or unlocked from the locking hole by rotation.

13. The spring module of claim 12, wherein the latch member is configured to pass through the locking hole in a first orientation relative to the locking hole and to be locked in a different second orientation relative to the locking hole.

14. The spring module of claim 13, wherein when the latch member is locked by the locking hole, the end tip of the latch member is flush with a bottom surface of the base or recessed relative to the bottom surface of the base.

15. The spring module according to claim 14, wherein one or more detent features are provided on the bottom surface of the base to prevent the latch member from rotating from the second orientation toward the first orientation.

16. The spring module of claim 12, further comprising a plurality of grooves and/or protrusions on a circumference of the base portion.

17. A spring cushion furniture, comprising:

a base fabric comprising a zipper at a periphery of a base fabric;

a plurality of spring modules, each spring module including a spring; a base having a first spring attaching portion and a base locking portion, the first spring attaching portion configured to releasably attach a first end of the spring; and an end cap including a cap body having a second spring attaching portion configured to releasably attach a second end of the spring, an end cap locking portion configured to lock and unlock with the base locking portion, and a flexible connector connecting the cap body to the end cap locking portion radially inside of the spring, wherein the cap body, the end locking portion, and the flexible connector are formed as a single part and are configured to be detachably mounted to the base; wherein the base of each spring module pre-fixed on the base fabric; and cover fabric having a zipper engageable with the zipper of the base fabric so that the cover fabric can be detachably connected to the base fabric, thereby forming a space for accommodating the plurality of spring modules.

18. The spring cushion of claim 17, further comprising a sponge layer formed with a plurality of recesses, each recess configured to receive the cap body of an end cap.

19. The spring cushion of claim 18, further comprising one or more pad layers disposed between the sponge layer and the cover fabric.

* * * * *